US005505246A

United States Patent [19]

Colvin et al.

[11] Patent Number: 5,505,246

[45] Date of Patent: Apr. 9, 1996

[54] PERMANENT MOLD OR DIE CASTING OF TITANIUM-ALUMINUM ALLOYS

[75] Inventors: Gregory N. Colvin, Muskegon; Steven A. Salter, Whitehall; Andrew L. Matthews, Muskegon, all of Mich.

[73] Assignee: Howmet Corporation, Greenwich, Conn.

[21] Appl. No.: 261,484

[22] Filed: Jun. 17, 1994

[51] Int. Cl.[6] ..... B22D 27/15; B22D 27/20; B22D 27/13; B22C 3/00

[52] U.S. Cl. ..... 164/61; 164/57.1; 164/66.1; 164/72; 164/158

[58] Field of Search ..... 164/66.1, 67.1, 164/68.1, 72, 74, 158, 57.1, 61

[56] References Cited

U.S. PATENT DOCUMENTS

| | | | |
|---|---|---|---|
| 209,237 | 10/1878 | Davis et al. . | |
| 913,728 | 3/1909 | Howe . | |
| 966,306 | 8/1910 | Brown . | |
| 1,493,603 | 5/1924 | Coates . | |
| 1,580,689 | 4/1926 | Shoemaker et al. . | |
| 1,891,197 | 12/1932 | Andrews | 164/158 |
| 2,806,271 | 9/1957 | Operhall . | |
| 3,005,246 | 10/1961 | Murphy et al. . | |
| 3,779,816 | 12/1973 | Mao . | |
| 3,849,879 | 11/1974 | Kuchek . | |
| 4,907,642 | 3/1990 | Gabis et al. . | |
| 5,065,809 | 11/1991 | Sato et al. | 164/66.1 |
| 5,119,865 | 6/1992 | Mae et al. . | |
| 5,287,910 | 2/1994 | Colvin et al. | 164/63 |

FOREIGN PATENT DOCUMENTS

| | | |
|---|---|---|
| 705314 | 3/1965 | Canada . |
| 53-47490 | 12/1978 | Japan . |
| 61-273235 | 12/1986 | Japan . |
| 64-44256 | 2/1989 | Japan . |
| 2-284754 | 11/1990 | Japan . |
| 833360 | 5/1981 | U.S.S.R. . |

*Primary Examiner*—Kuang Y. Lin
*Attorney, Agent, or Firm*—Edward J. Timmer

[57] ABSTRACT

Method and apparatus are provided for casting titanium-aluminum alloys including generally 10 weight % or more Al in a reusable metallic mold or die in a manner that retards or avoids build-up of a deleterious aluminum layer on the mold or die cavity surfaces that adversely affects surface quality of castings solidified therein.

11 Claims, 1 Drawing Sheet

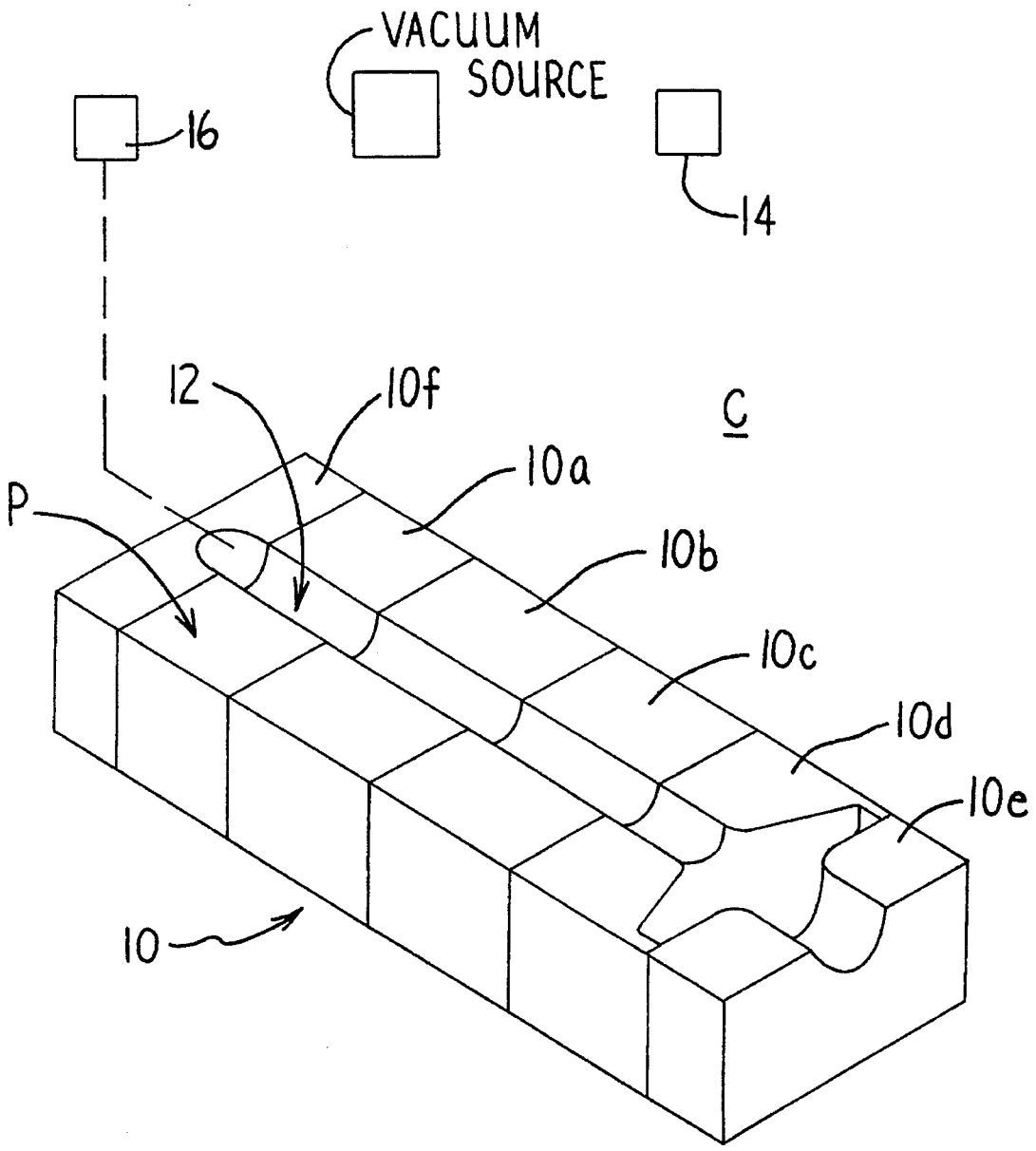
VACUUM
SOURCE
16
14
12
10f
C
10a
P
10b
10c
10d
10e
10

PERMANENT MOLD OR DIE CASTING OF TITANIUM-ALUMINUM ALLOYS

FIELD OF THE INVENTION

The present invention relates to the casting of successive charges of a titanium-aluminum alloy in a reusable, metallic mold or die in a manner to avoid formation of an aluminum layer on the mold or die cavity surfaces that adversely affects surface quality of castings solidified therein.

BACKGROUND OF THE INVENTION

Permanent mold casting has been employed in the past as a relative low cost casting technique to mass produce aluminum, copper, and iron based castings having complex, near net shape configurations. Only fairly recently have attempts been made to produce titanium and titanium based alloy castings using permanent mold casting. For example, the Mae et al. U.S. Pat. No. 5,119,865 issued Jun. 9, 1992, discloses a copper alloy mold assembly for use in the permanent mold, centrifugal casting of titanium and titanium based alloys.

The Colvin U.S. Pat. No. 5,287,910 of common assignee herewith describes casting of reactive metals and alloys such as titanium, titanium alloys, and nickel based superalloys in reusable, metallic molds or dies made of iron based and/or titanium based alloys and having certain mold body-to-mold cavity volume ratios.

In the casting of titanium-aluminum alloys in metallic molds, the inventors have discovered that certain alloys having aluminum concentrations generally exceeding about 10 weight % aluminum result in the deposition of an aluminum layer on the metallic mold surfaces relatively quickly as successive alloy charges are cast in the mold under a relative high vacuum, such as less than 100 microns (0.1 Torr). The aluminum layer was found to adversely affect the surface quality of successive castings made in the mold. In particular, the deposited aluminum layer produced a rough as-cast surface finish on the castings and eventually caused subsequent castings to adhere to the mold after several alloy charges were introduced into the mold.

An object of the invention is to provide method and apparatus for casting titanium-aluminum alloys in a metallic mold or die in a manner that retards or avoids deposition of the aforementioned deleterious aluminum layer on the mold or die cavity surfaces.

Another object of the invention is to provide method for casting titanium-aluminum alloys in a metallic mold or die wherein the deleterious aluminum layer is periodically removed from the mold or die surfaces.

SUMMARY OF THE INVENTION

In an embodiment of the present invention, method and apparatus are provided for casting successive charges of an alloy comprising titanium and aluminum wherein aluminum is present in the alloy in an amount exceeding generally 10 weight % in a manner that retards or avoids deposition of the aforementioned deleterious layer comprising aluminum on the metallic mold or die cavity surfaces. One particular embodiment of the present invention involves casting successive molten alloy charges into a metallic mold or die cavity having a gaseous atmosphere therein that is non-reactive with the charge and that has a pressure high enough to retard or avoid deposition of the aluminum layer on surfaces of the cavity that adversely affects surface quality of castings solidified therein. The gaseous atmosphere typically comprises an inert or other non-reactive gas at a pressure of at least 50 torr, preferably argon at 50 to 100 torr or more.

In still another embodiment of the invention, the mold or die cavity surface comprises Fe-based material and/or Ni-based material which exhibit(s) a reduced tendency to deposition of the deleterious aluminum layer thereon as successive charges are cast.

In still a further embodiment of the invention, surfaces of the mold or die contacting the alloy are coated with a coating selected from at least one of TiN, VC, FeO and $PtAl_2$ that exhibits a reduced tendency for deposition of the deleterious aluminum layer thereon as successive charges are cast.

In still another embodiment of the invention, an additive is included in the alloy effective to retard deposition of the deleterious aluminum layer on the mold or die cavity surfaces as successive charges are cast. Boron or like alloy additive is used to this end.

In still a further embodiment of the invention, the deleterious aluminum layer is periodically removed from the mold or die cavity surfaces by cleaning the mold or die cavity surfaces with a caustic solution that dissolves the layer. For example, the solution can comprise an aqueous NaOH solution to this end.

The present invention can be used in permanent mold casting, die casting and other casting techniques employing a metallic mold or die.

The aforementioned and other objects and advantages of the present invention will become apparent from the following detailed description and the drawings.

BRIEF DESCRIPTION OF THE DRAWING

The Figure is a schematic perspective view of a so-called rainbow mold or die half adapted to mate with a like other mold or die half to form a melt-receiving cavity for casting trials.

DESCRIPTION OF THE INVENTION

The present invention relates to the discovery that certain titanium-aluminum alloys having relatively high aluminum concentrations can deposit a deleterious aluminum layer on melt-contacting surfaces of a reusable, metallic mold or die as successive charges of the alloy are cast therein under a relatively high vacuum, such as less than 100 microns (0.1 torr). Such reusable metallic molds or dies are used in permanent mold casting where the melt is gravity fed to the casting and die casting where the melt is injected into the cavity. For illustration, in casting successive charges (7 pounds each) of the well known gamma titanium-aluminum alloy (TiAl) having 33.5 weight % Al at a superheat of 50° C. in an uncooled metal mold or die (e.g. steel-1040 AISI), an aluminum layer was found to deposit on the mold or die cavity surfaces after several charges were successively cast. Scanning electron microscope analysis of the deposited layer on the mold or die cavity surfaces indicated the layer was nearly pure aluminum. The aluminum surface layer appeared as a white colored layer and was found to build up in thickness after several successive charges were cast and eventually reached a thickness of 0.001 inch where the layer began to flake off of the mold or die surfaces.

Deposition of an aluminum layer also was observed when TiAl charges were similarly successively cast in contact with other mold or die cavity materials in experimental casting trials. For example, the aluminum layer was observed to deposit when TiAl charges were successively cast in a so-called rainbow mold or die comprising two uncooled mold or die halves, one mold or die half being illustrated in the Figure. The other mold or die half (not shown) is like that illustrated in the Figure and is adapted to mate therewith at parting plane P to define a melt-receiving cavity 12 (half of the cavity shown) illustrated as a valve for an internal combustion engine. Each mold or die half 10 includes multiple inserts 10*a*, 10*b*, 10*c* for forming (molding) the stem portion of the cast valve when melt is cast in the mold or die. The remaining inserts 10*d*, 10*e*, 10*f* form (mold) the remainder of the cast valve when melt is cast in the mold or die. The inserts 10*a* through 10*f* are held together by suitable cap screws (not shown) extending through the inserts. The mold or die halves 10 are held together at the parting plane P by mechanical clamping to form the melt-receiving cavity 12.

The inserts 10*a*, 10*b* and 10*c* comprise compositionally different metallic uncooled inserts defining respective stem sections of the melt-receiving cavity 12 for receiving and molding the TiAl alloy melt. Inserts 10*d*, 10*e*, 10*f* were made of steel (e.g. AISI 1040 steel). The tendency to deposit the deleterious aluminum layer was dependent to some extent upon the mold or die cavity material in contact with the melt as it solidifies. For example, Fe-based (e.g. steel such as 1040, H13 and P20) and Ni-based (e.g. IN 718) mold or die cavity materials (inserts) exhibited a lesser tendency to produce deposition of the aluminum layer thereon than Cu-based (e.g. Cp (commercially pure) copper) or Ti-based (e.g. Ti-6Al-4V) mold or die cavity materials (inserts) when the TiAl alloy charge at a superheat of 50° C. under a vacuum of less than 100 microns (0.1 torr) was cast in the rainbow mold or die. That is, the rate of build-up of the aluminum layer was slower on the Fe-based and Ni-based materials and faster on the Cu-based and Ti-based materials in such casting experimental tests.

On the other hand, casting of titanium-aluminum alloys having a lower aluminum concentration (e.g. not exceeding 10 weight % Al) under similar casting conditions evidences a lesser tendency to deposit the deleterious aluminum layer on the mold or die cavity surfaces (inserts) after successive charges are cast. For example, after 20 charges of the well known Ti-6Al-4V alloy melt were cast under conditions similar to those described above, there was no visible aluminum layer on like uncooled rainbow mold or die cavity surfaces (e.g. Fe-based, Ni-based, Cu-based, Ti-based inserts).

The observed deposition of the aluminum layer on the mold or die cavity surfaces was unexpected and exerted a deleterious effect on the quality of the as-cast surface finish of the cast specimens. In particular, the deposited aluminum layer imparted a rough as-cast surface finish to the subsequent castings and eventually caused subsequent castings to adhere to the mold or die surfaces after several alloy charges were introduced into the mold.

In one embodiment of the present invention, the titanium-aluminum alloy melt having an aluminum concentration high enough to ordinarily deposit the deleterious aluminum layer is successively cast or introduced to a melt-receiving cavity of a metallic mold or die wherein the melt-receiving cavity has a gaseous atmosphere therein that is non-reactive with the alloy charge and that has a pressure high enough to retard deposition of the deleterious aluminum layer on the mold or die cavity surfaces. The gaseous atmosphere can be provided generally in the casting furnace by backfilling the furnace chamber C from a gaseous source 14 or, alternately, locally in the mold or die cavity by connection thereof to a tank 16 containing the gaseous atmosphere. The gaseous atmosphere typically would be vented from the melt-receiving cavity 12 through a suitable vent (not shown) in the mold or die so that the atmosphere is displaced from the cavity 12 as the alloy charge (melt) is cast therein. The gaseous atmosphere typically comprises an inert gas at a pressure of at least 50 torr to retard or avoid deposition of the aluminum layer on the mold or die cavity surfaces although other gas pressures may be used in practicing the invention. A preferred gaseous atmosphere for practicing the invention comprises argon at 50 to 100 torr or more.

The casting mold or die may be evacuated as the charge of alloy melt is introduced into the cavity 12 to facilitate thorough filling of the cavity 12 as described in U.S. Pat. No. 5,287,910, the teachings of which are incorporated herein by reference.

Experimental casting trials in rainbow molds or dies described above under the casting conditions described were conducted to determine the minimum gas partial pressure for preventing deposition of the deleterious aluminum layer. In these trails, each uncooled rainbow mold or die was disposed in a conventional casting furnace that initially was evacuated to 10 microns while the TiAl alloy was melted in a copper crucible. Alternately, the TiAl melt could be melted under an inert gas atmosphere.

Prior to pouring of the alloy melt from the crucible into each rainbow mold or die (e.g. 10 seconds prior to pouring), the casting furnace was backfilled with high purity argon from an argon cylinder to different partial pressures of 400, 300, 200, 100, 50, 10 torr and less than 0.1 torr (no Ar was added as a standard) for different casting trials. The argon partial pressure greater or equal to 50 torr was found to prevent deposition of aluminum on the mold or die cavity materials (inserts) while aluminum deposition was observed at the 10 torr argon pressure levels used. Repeated pours of alloy melt at greater than or equal to 50 torr argon showed no aluminum layer deposition.

In these trials, the Fe-based (e.g. steel), Ni-based (e.g. IN 718), Cu-based (e.g. Cp Cu), and Ti-based (e.g. Ti-6Al-4V) mold or die cavity materials (inserts) exhibited different tendency to deposition of the deleterious aluminum layer thereon as successive charges were cast, although all of these materials showed aluminum deposition thereon after one (1) charge was cast when the argon partial pressure was less than 50 tort. For example, the rate of build-up of the aluminum layer was slower on the Fe-based and Ni-based materials (inserts) and faster on the Cu-based and Ti-based materials (inserts) in such casting experimental tests. Preferred mold or die cavity materials for practicing an embodiment of the invention will comprise those based on Fe and Ni which exhibit a lesser tendency for aluminum deposition thereon during casting of successive molten charges of titanium-aluminum alloy.

Further, in practicing another embodiment of the invention, the mold or die cavity materials are coated with coatings effective to retard deposition or make removal easier of the deleterious aluminum layer thereon during casting of successive charges of titanium-aluminum alloy. For example, further casting trials were conducted in the manner described above using uncooled rainbow molds or dies having Fe-based mold or die cavity inserts 10*a*, 10*b*, 10*c* coated with TiN, VC, FeO, $PtAl_2$ and BN. These coatings were applied by standard coating methods such as CVD or pack-cementation to a thickness of approximately 0.001 inch for each coating. The TiAl melt was cast in the rainbow mold or die in the manner described above using the aforementioned different argon pressures such that alloy melt was solidified in contact with the TiN, VC, FeO, $PtAl_2$ and BN coated inserts. The TiN, VC, FeO, and $PtAl_2$ coatings retarded deposition of the deleterious aluminum layer on the coated die cavity surfaces as compared to uncoated inserts or BN coated inserts. However, all of the TiN, VC, FeO, and $PtAl_2$ coating materials showed aluminum deposition thereon after 3 charges were cast when the argon partial pressure was less than 50 torr. Preferred mold or die coatings for practicing this embodiment of the invention will comprise TiN, VC, FeO and $PtAl_2$ which exhibit a lesser tendency for aluminum deposition thereon during casting of successive charges. These coatings can be applied to various mold or die substrate materials such as Fe-based, Ni-based, Cu-based, Ti-based and others to enable a variety of substrate materials to be used in fabrication of the mold or die depending requirements of a given casting application.

In another embodiment of the invention, an additive is included in the titanium-aluminum alloy effective to retard deposition of the deleterious aluminum layer on the mold or die cavity surfaces as successive charges are cast. For example, further casting trials were conducted in the manner described above using uncooled rainbow molds or dies having Fe-based inserts. In one trial, the TiAl melt included boron to form titanium boride dispersoids (e.g. $TiB_2$) upon solidification of the alloy. Boron was added to the melt in an amount to form 0.8 volume % titanium borides in the solidified alloy casting. The boron was added to the melt in elemental B powder form. A TiAl melt devoid boron also was cast in a like rainbow mold or die in like manner for comparison. The TiAl melt including boron retarded deposition of the deleterious aluminum layer on the rainbow mold or die cavity materials as compared to the TiAl melt devoid of boron. However, both the boron-bearing melt and boron-free melt showed aluminum deposition on the mold or die cavity materials after 5 charges were cast when the argon partial pressure was less than 50 torr. For practicing this embodiment of the invention, the titanium-aluminum melt will include an additive, such as boron, that retards the deposition of the deleterious aluminum layer on the mold or die cavity surfaces during casting of successive charges.

In the casting trails described above where the aluminum layer was observed to deposit on the mold or die cavity materials after successive charges were cast, the rainbow mold or die was periodically cleaned to remove the aluminum layer from the mold or die surfaces to enable reuse of the mold or die in casting trials. Cleaning of the mold or die cavity surfaces was effected with a causticssolution effective to dissolve the deposited aluminum layer. For example, an aqueous 5 volume % NaOH solution was employed to remove the deposited aluminum layer from the mold or die surfaces. Typically, the rainbow mold or die materials were cleaned by immersion in the cleaning solution thereon until the deposit was removed or dissolved. This embodiment of the invention permits the mold or die cavity to be periodically cleaned, if necessary, to remove deleterious aluminum deposit therefrom and used in the casting of additional parts.

Although particular embodiments of the invention have been described in detail for illustrative purposes, it will be understood that variations or modifications can be made thereto within the scope of the invention as described in the appended claims.

The embodiments of the invention in which an exclusive property or privilege is claimed are defined as follows:

1. A method of casting successive charges of an alloy comprising titanium and aluminum wherein aluminum is present in the alloy in an amount exceeding generally 10 weight % of the alloy, comprising a) introducing a charge of alloy melt into a metallic mold or die having a melt-receiving cavity, b) providing a gaseous atmosphere in said cavity prior to introduction of said alloy melt wherein said atmopshere is non-reactive with the charge and is provided at a pressure of at least 50 Torr to retard deposition of a layer comprising aluminum on surfaces of said cavity that adversely affects surface quality of a casting soldified therein, and reteating steps a) and b) to cast successive charges of alloy melt in said cavity.

2. The method of claim 1 wherein the gaseous atmosphere comprises an inert gas at a pressure of at least 50 Torr.

3. The method of claim 2 wherein the gaseous atmosphere comprises argon at 50 to 100 Torr.

4. The method of claim 1 wherein said gaseous atmosphere is present locally in said cavity.

5. The method of claim 4 wherein said gaseous atmosphere is vented from said cavity as the charge is introduced and displaces said gaseous atmosphere.

6. The method of claim 1 wherein the mold or die cavity surfaces comprise at least one of an Fe-based material and Ni-based material which exhibits a reduced tendency to deposition of said layer thereon.

7. The method of claim 1 or 6 wherein surfaces of the mold or die contacting the alloy are coated with a coating selected from at least one of TiN, VC, FeO and $PtAl_2$ that exhibits a reduced tendency to deposition of said layer thereon.

8. The method of claim 1 wherein an additive is included in the alloy effective to retard deposition of said layer on the mold or die cavity surfaces that adversely affects surface quality of castings solidified therein.

9. The method of claim 6 wherein boron is included in the alloy.

10. A method of casting successive charges of an alloy comprising titanium and aluminum wherein aluminum is present in the alloy in an amount exceeding generally 10 weight % of the alloy, comprising a) introducing a charge of alloy melt into a reusable mold or die comprising Fe-based material and having a melt-receiving cavity, b) providing an inert gas atmosphere in said cavity prior to introduction of said alloy melt wherein said atmosphere is at a pressure of at least 50 Torr to retard deposition of a layer comprising aluminum on surfaces of said cavity that adversely affects surface quality of a casting solidified therein, and repeating steps a) and b) to cast successive charges of alloy melt in said cavity.

11. A method of casting successive charges of an alloy comprising titanium and aluminum wherein aluminum is present in the alloy in an amount exceeding generally 10 weight % of the alloy, comprising a) casting a charge of alloy melt into a melt-receiving cavity of a reusable, metallic mold or die, b) prior to casting said alloy, providing an additive in said alloy effective to retard deposition of a layer comprising aluminum on surfaces of said cavity that adversely affects surface quality of a casting solidified therein and repeating steps a) and b) to cast successive charges of said alloy having said additive in said cavity.

* * * * *